US008198535B2

(12) United States Patent
Park et al.

(10) Patent No.: US 8,198,535 B2
(45) Date of Patent: Jun. 12, 2012

(54) COAXIAL CABLE

(75) Inventors: Chan-Yong Park, Seoul (KR); Bong-Kwon Cho, Busan (KR); Gi-Joon Nam, Seoul (KR); Hyoung-Koog Lee, Gwengmyeong-si (KR); Jung-Won Park, Seongnam-si (KR); Dae-Sung Lee, Gumi-si (KR)

(73) Assignee: LS Cable & System Ltd., Anyang, Gyeonggi-do (KR)

( * ) Notice: Subject to any disclaimer, the term of this patent is extended or adjusted under 35 U.S.C. 154(b) by 4 days.

(21) Appl. No.: 12/518,062

(22) PCT Filed: Nov. 8, 2007

(86) PCT No.: PCT/KR2007/005623

§ 371 (c)(1),
(2), (4) Date: Dec. 7, 2010

(87) PCT Pub. No.: WO2008/069462

PCT Pub. Date: Jun. 12, 2008

(65) Prior Publication Data

US 2011/0073348 A1 Mar. 31, 2011

(30) Foreign Application Priority Data

Dec. 7, 2006 (KR) ..... 10-2006-0123906

(51) Int. Cl.
*H01B 11/18* (2006.01)

(52) U.S. Cl. ..... 174/102 R

(58) Field of Classification Search ..... 174/102 R, 174/110 R, 120 R
See application file for complete search history.

(56) References Cited

U.S. PATENT DOCUMENTS

| | | | | |
|---|---|---|---|---|
| 6,417,445 | B1 | 7/2002 | Sato et al. | |
| 7,915,526 | B2 * | 3/2011 | Fagrell et al. | 174/28 |
| 2003/0087975 | A1 * | 5/2003 | Bufanda et al. | 521/134 |
| 2003/0201116 | A1 * | 10/2003 | Carlson et al. | 174/102 R |
| 2004/0222009 | A1 * | 11/2004 | Blew et al. | 174/110 F |
| 2007/0205008 | A1 * | 9/2007 | Witthoft | 174/28 |

FOREIGN PATENT DOCUMENTS

| | | | |
|---|---|---|---|
| EP | 0 465 113 | A1 | 1/1992 |
| EP | 1 067 561 | A2 | 1/2001 |
| JP | 2001-256839 | | 9/2001 |
| JP | 2004-014337 | | 1/2004 |
| JP | 2005108576 | * | 4/2005 |
| KR | 10-2001-0015137 | | 2/2001 |

* cited by examiner

*Primary Examiner* — Chau Nguyen
(74) *Attorney, Agent, or Firm* — Sherr & Vaughn, PLLC

(57) ABSTRACT

A coaxial cable includes a central conductor made of cylindrical conductive material with conductivity greater than 100% and smaller than 104%, the central conductor having a thickness greater than 0.1 mm and smaller than 0.5 mm; a dielectric layer surrounding the central conductor and made of insulating material; an outer conductor surrounding the dielectric layer and made of conductive material with conductivity greater than 97% and smaller than 105% and a thickness greater than 0.24 mm and smaller than 0.35 mm; and an outer jacket surrounding the outer conductor. This coaxial cable allows stable transmission of signal even at a high frequency.

18 Claims, 3 Drawing Sheets

[Fig. 1]
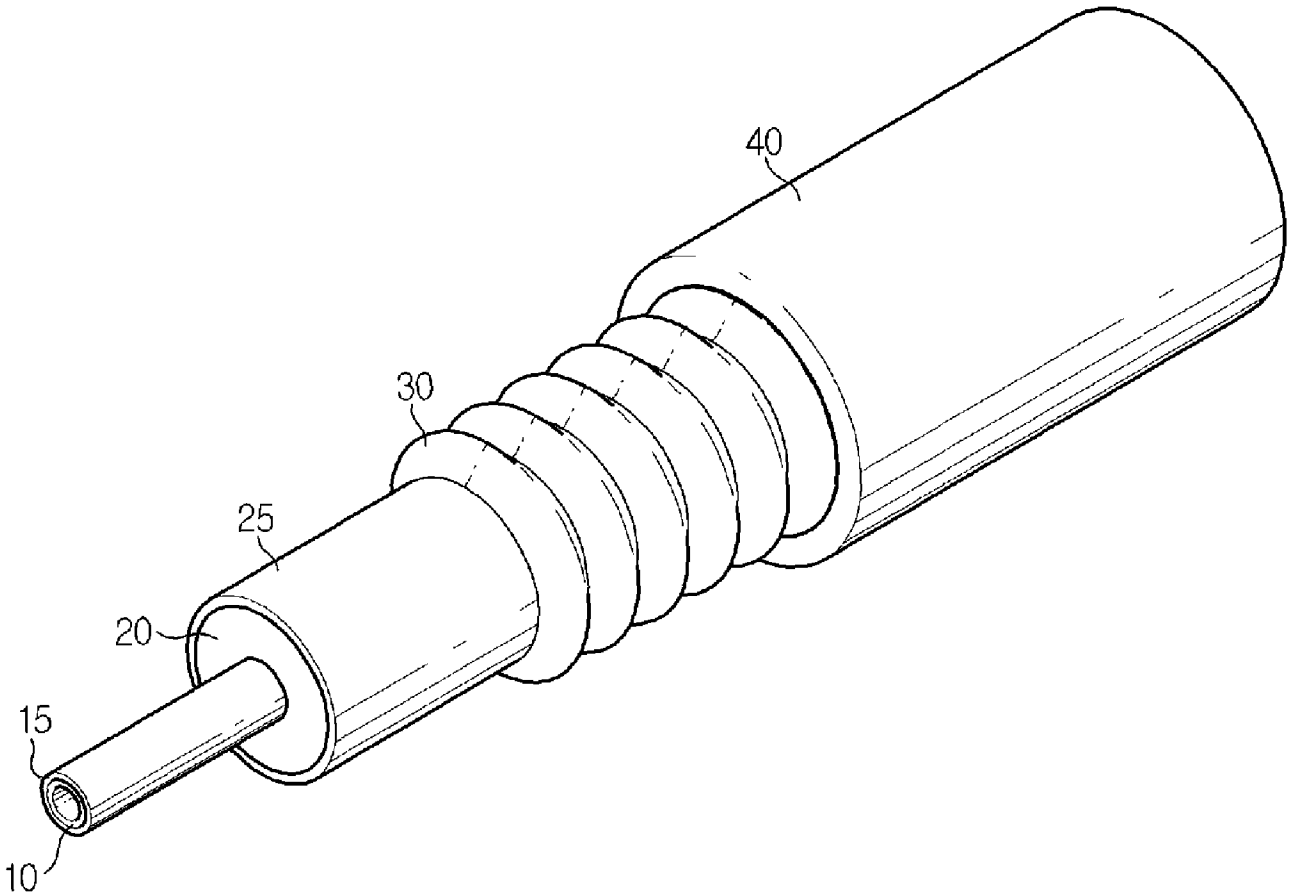

[Fig. 2]
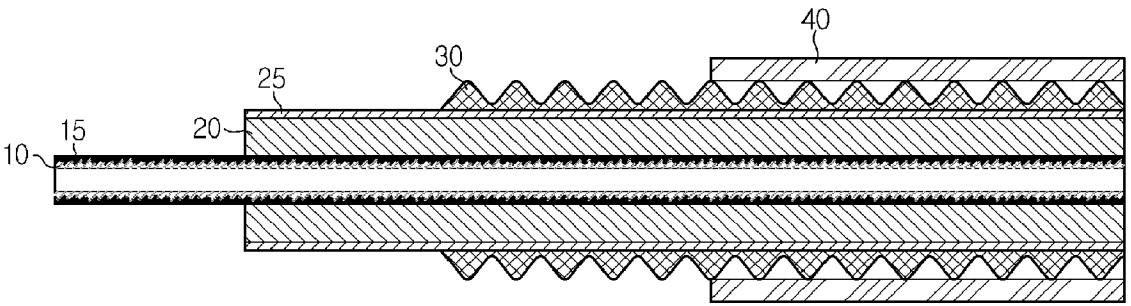
[Fig. 3]
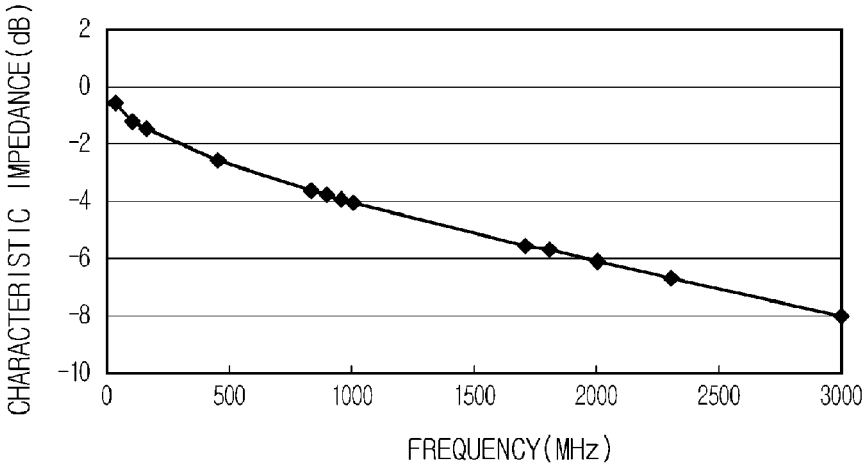

[Fig. 4]
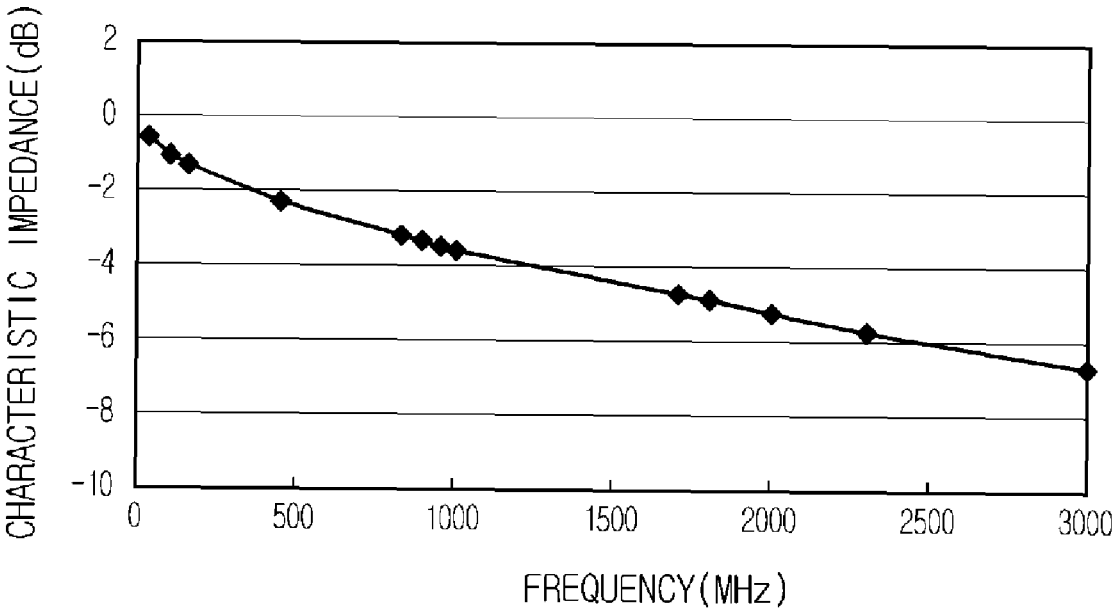

COAXIAL CABLE

CROSS REFERENCE TO PRIOR APPLICATIONS

The present application is a National Stage Application of PCT International Application No. PCT/KR2007/005623 (filed on Nov. 8, 2007), under 35 U.S.C. 371, which claims priority to Korean Patent Application No. 10-2006-0123906 (filed on Dec. 7, 2006), which is hereby incorporated by reference in its entirety.

TECHNICAL FIELD

The present invention relates to a coaxial cable, and more particularly to a coaxial cable that allows stable transmission of signal even at a high frequency.

BACKGROUND ART

Generally, a coaxial cable is frequently used for transmission of RF signals such as cable TV signals and cellular phone broadcasting signals.

The coaxial cable includes a central conductor, an outer conductor coaxially formed on the central conductor, a dielectric layer formed between the central conductor and the outer conductor, and a sheath surrounding the outer conductor.

In case a signal is transmitted using the above coaxial cable, a loss of transmitted signal occurs due to electric conductivities of the central conductor and the outer conductor and a dielectric constant of the dielectric layer. Thus, when making a coaxial cable, it is most important to effectively reduce a transmission loss.

Conventionally, a method of improving a shielding performance was frequently used in order to reduce a transmission loss. In detail, in most cases, a dimension structure of the central conductor and the outer conductor was improved in the designing step so as to reduce a dielectric constant of the dielectric layer, a dielectric characteristic of the dielectric substance was improved, or a shielding characteristic of the outer conductor was reinforced.

However, the above methods are advantageous in reducing a transmission loss of a coaxial cable by improving a shielding performance, but they cannot directly improve transmission characteristics of the central conductor and the outer conductor.

DISCLOSURE OF INVENTION

Technical Problem

The present invention is designed to solve the problems of the prior art, and therefore it is an object of the present invention to provide a coaxial cable that may reduce a transmission loss even in an environment of transmitting a high frequency signal by controlling conductivities and thickness of a central conductor and an outer conductor provided therein.

Technical Solution

In order to accomplish the above object, the present invention provides a coaxial cable, which includes a central conductor made of cylindrical conductive material with conductivity greater than 100% and smaller than 104%, the central conductor having a thickness greater than 0.1 mm and smaller than 0.5 mm; a dielectric layer surrounding the central conductor and made of insulating material; an outer conductor surrounding the dielectric layer and made of conductive material with conductivity greater than 97% and smaller than 105% and a thickness greater than 0.24 mm and smaller than 0.35 mm; and an outer jacket surrounding the outer conductor.

In particular, it is preferred that the central conductor has conductivity of 102% and a thickness in the range of 0.25 mm to 0.3 mm, and the outer conductor has conductivity in the range of 102% to 103% and a thickness in the range of 0.25 mm to 0.35 mm.

Preferably, both of the central conductor and the outer conductor are made of nonferrous metal.

The central conductor or the outer conductor may be made of any one material selected from the group consisting of copper, copper alloy, silver alloy, and silver plating.

The central conductor may have a conductive layer made of conductive material, and a spiral wrinkle is formed on an outer portion of the conductive layer.

Preferably, an inner skin layer made of insulating material may be coated as a thin film on a surface of the central conductor, and an outer skin layer may be coated on an outer surface of the dielectric layer.

BRIEF DESCRIPTION OF THE DRAWINGS

Other objects and aspects of the present invention will become apparent from the following description of embodiments with reference to the accompanying drawing in which:

FIG. 1 is a perspective view showing a coaxial cable according to a preferred embodiment of the present invention;

FIG. 2 is a sectional view showing the coaxial cable according to the preferred embodiment of the present invention;

FIG. 3 is a graph showing a characteristic impedance measured according to a comparative example among experimental examples of the present invention; and FIG. 4 is a graph showing a characteristic impedance measured according to an embodiment among experimental examples of the present invention.

REFERENCE NUMERALS OF ESSENTIAL PARTS IN THE DRAWINGS

10: central conductor
15: inner skin layer
20: dielectric layer
25: outer skin layer
30: outer conductor
40: outer jacket

BEST MODE FOR CARRYING OUT THE INVENTION

Hereinafter, preferred embodiments of the present invention will be described in detail with reference to the accompanying drawings. Prior to the description, it should be understood that the terms used in the specification and the appended claims should not be construed as limited to general and dictionary meanings, but interpreted based on the meanings and concepts corresponding to technical aspects of the present invention on the basis of the principle that the inventor is allowed to define terms appropriately for the best explanation. Therefore, the description proposed herein is just a preferable example for the purpose of illustrations only, not intended to limit the scope of the invention, so it should be understood that other equivalents and modifications could be made thereto without departing from the spirit and scope of the invention.

FIG. 1 is a perspective view showing a coaxial cable according to a preferred embodiment of the present invention, and FIG. 2 is a sectional view showing the coaxial cable according to the preferred embodiment.

Referring to FIGS. 1 and 2, the coaxial cable according to this embodiment includes a central conductor 10, a dielectric layer 20, an outer conductor 30 and an outer jacket 40.

The central conductor 10 is configured with a cylindrical member obtained by processing a plate-type conductive material, and the central conductor 10 plays a role of a main transmission medium for data transmission. Here, the central conductor 10 is made of a material with excellent electric conductivity such as copper, copper alloy, silver alloy, or silver plating.

The central conductor 10 preferably has a spiral winding on its outer surface so as to improve a bending characteristic.

In case the central conductor 10 has conductivity of 100% or below, loss of signal transmission is increased. Meanwhile, in case the central conductor 10 has conductivity of 104% or above, the transmission characteristics are not changed greatly, but a manufacture cost is increased, which deteriorates efficiency in comparison to cost. Thus, the conductivity of the central conductor 10 is preferably greater than 100% and smaller than 104%. Further, the conductivity of the central conductor 10 is more preferably 102%, which ensures best transmission efficiency in comparison to cost.

In addition, in case the central conductor 10 has a thickness of 0.1 mm or less, its strength is weakened, so it may not give a sufficient supporting act as a central conductor 10. Also, in case the central conductor 10 has a thickness of 0.5 mm or more, welding characteristics are greatly deteriorated together with increased weight and difficult impedance matching. Thus, the thickness of the central conductor 10 is preferably greater than 0.1 mm and smaller than 0.5 mm. Further, the thickness of the central conductor is more preferably in the range of 0.25 mm to 0.35 mm, within which the central conductor 10 may keep optimal strength, welding characteristics, weight and impedance matching suitably for acting the supporting role.

The dielectric layer 20 is an insulating material formed to surround the central conductor 10. Preferably, the dielectric layer 20 may be made of polymer material (e.g., PE (polyethylene) or PP (polypropylene)) that shows a low dielectric constant or easy foaming, in order to improve transmission characteristics of the central conductor 10. In addition, an outer skin layer 25 made of polymer resin similarly to the dielectric layer 20 is preferably coated on an outer surface of the dielectric layer 20 so as to restrain over-foaming of the dielectric layer 20.

Further, an inner skin layer 15 is preferably coated on the outer surface of the central conductor 10 in order to improve an interfacial adhesive force with the dielectric layer 20.

The outer conductor 30 is provided on the same axis as the central conductor 10, and the outer conductor 30 is made of conductive material. Preferably, the outer conductor 30 may be made of a material with excellent electric conductivity such as copper, copper alloy, silver alloy, or silver plating. In particular, if silver plating is formed on an inner surface of the outer conductor 30, namely on a surface of the outer conductor 30 that contacts with the dielectric layer 20, most signals are shielded within the outer conductor 30, so it is possible to keep excellent shielding performance. Thus, the surface of the outer conductor 30 that contacts with the dielectric layer 20 is more preferably silver-plated.

In addition, in case the outer conductor 30 has conductivity of 97% or below, loss characteristics are greatly deteriorated. Meanwhile, in case the outer conductor 30 has conductivity of 105% or above, a manufacture cost is greatly increased but conduction performance is not greatly improved, so a transmission efficiency is deteriorated. Thus, the conductivity of the outer conductor 30 is preferably greater than 97% and smaller than 105%.

In case the outer conductor 30 has a thickness of 0.24 mm or less, a unit resistance is increased, thereby deteriorating electric conductivity. Also, this outer conductor has a weak strength, so it may be easily broken due to an external force. Meanwhile, in case the outer conductor 30 has a thickness of 35 mm or more, weight of the outer conductor 30 is increased with no substantial change of electric conductivity, so it is difficult to keep impedance matching. Thus, the thickness of the outer conductor 30 is preferably greater than 0.25 mm and smaller than 0.35 mm in the range of which the outer conductor 30 may keep optimal strength, weight and impedance matching suitably for the supporting role.

Further, in case the central conductor 10 is made of nonferrous metal and the outer conductor 30 is made of ferrous metal (e.g., Fe), magnetic permeability between the central conductor 10 and the outer conductor 30 becomes asymmetric, so a great loss occurs even when low-frequency signal is transmitted to the central conductor 10. Thus, if the central conductor 10 is made of nonferrous metal, the outer conductor 30 is preferably made of nonferrous metal.

Now, using the following experimental examples, it will be checked that transmission characteristics are changed according to conductivity and thickness of the central conductor 10 and the outer conductor 30, and also it will be looked that a loss characteristic is improved by control of conductivity and thickness.

COMPARATIVE EXAMPLE

A conventional coaxial cable prepared in this comparative example was composed of a central conductor, a dielectric layer, an outer conductor and a sheath. The central conductor was made of flat-plate copper alloy, and 1 ppm of silver, 20 ppm of oxygen and 40 ppm of phosphorus were added thereto during a manufacturing process to control conductivity to 95%. In addition, the central conductor had a thickness of 0.45 mm. This central conductor was prepared in a cylindrical shape with a hollow. An end of the central conductor was welded, and the central conductor was configured to have a spiral winding in a length direction thereof. The dielectric layer was made of foamed PP (polypropylene) and configured to surround the central conductor. The outer conductor was made of flat-plate copper plating, and 5 ppm of silver and 20 ppm of oxygen were added thereto during the manufacturing process to control conductivity to 97%. In addition, the outer conductor had a thickness of 0.45 mm, identically to the central conductor. This outer conductor was prepared to surround the dielectric layer. An end of the outer conductor was welded, and then the outer conductor was configured to have a spiral winding in a length direction thereof.

Also, a network analyzer was used to measure loss characteristics of the coaxial cable prepared as mentioned above, in a way of applying signals to the coaxial cable to increase frequency from 0 MHz to 3 GHz. Measured results are shown in FIG. 3.

EMBODIMENT

A coaxial cable prepared according to an embodiment of the present invention was composed of a central conductor 10, a dielectric layer 20, an outer conductor 30 and a sheath (or, an outer jacket) 40. The central conductor 10 was made of flat-plate copper alloy, and 15 ppm of silver and 10 ppm of oxygen were added thereto during a manufacturing process to control conductivity to 102%. In addition, the central conductor 10 had a thickness of 0.25 mm. This central conductor 10 was prepared in a cylindrical shape with a hollow. An end of the central conductor 10 was welded, and the central conductor 10 was configured to have a spiral winding in a length direction thereof. The dielectric layer 20 was made of foamed PP (polypropylene) to have fine foams therein and configured to surround the central conductor 10. At this time, before forming the dielectric layer 20, PE (polyethylene) having similar composition to the dielectric layer 20 was coated on an outer portion of the central conductor 10 to form an inner skin layer 15. Also, after forming the dielectric layer 20, an outer skin layer 25 for restraining over-foaming of the dielectric layer 20 was formed thereon. The outer conductor 30 was made of flat-plate copper plating, and 20 ppm of silver and 10 ppm of oxygen were added thereto during the manufacturing process to control conductivity to 103%. In addition, the outer conductor 30 had a thickness of 0.3 mm, identically to the central conductor 10. This outer conductor 30 was prepared to surround the dielectric layer 20. An end of the outer conductor 30 was welded, and then the outer conductor 30 was configured to have a spiral winding in a length direction thereof.

Also, a network analyzer was used to measure loss characteristics of the coaxial cable prepared as mentioned above, in a way of applying signals to the coaxial cable to increase frequency from 0 MHz to 3 GHz. Measured results are shown in FIG. 4.

Referring to FIGS. 3 and 4, as a result of measuring a characteristic impedance using the coaxial cable prepared according to the comparative example, a characteristic impedance measured in the range of 2 GHz is 6.15 dB, and a characteristic impedance measured in the range of 3 GHz is 8.03 dB. Meanwhile, as a result of measuring a characteristic impedance of the coaxial cable prepared according to the embodiment of the present invention, a characteristic impedance measured in the range of 2 GHz is 5.4 dB, and a characteristic impedance measured in the range of 3 GHz is 6.9 dB. That is to say, it would be understood that the coaxial cable prepared according to the embodiment of the present invention shows 10% improved loss characteristics in comparison to the coaxial cable prepared according to the comparative example.

The present invention has been described in detail. However, it should be understood that the detailed description and specific examples, while indicating preferred embodiments of the invention, are given by way of illustration only, since various changes and modifications within the spirit and scope of the invention will become apparent to those skilled in the art from this detailed description.

INDUSTRIAL APPLICABILITY

According to the coaxial cable according to the present invention, it is possible to decrease a transmission loss even at an environment of transmitting high frequency signals, by controlling conductivities and thicknesses of the central conductor and the outer conductor provided inside the coaxial cable.

The invention claimed is:

1. A coaxial cable, comprising:

a central conductor made of cylindrical conductive material with conductivity greater than 100% and smaller than 104%, the central conductor having a thickness greater than 0.1 mm and smaller than 0.5 mm;

a dielectric layer surrounding the central conductor and made of insulating material;

an outer conductor surrounding the dielectric layer and made of conductive material with conductivity greater than 97% and smaller than 105% and a thickness greater than 0.24 mm and smaller than 0.35 mm; and an outer jacket surrounding the outer conductor.

2. The coaxial cable according to claim 1, wherein the central conductor has conductivity of 102% and a thickness in the range of 0.25 mm to 0.3 mm.

3. The coaxial cable according to claim 2, wherein the outer conductor has conductivity in the range of 102% to 103% and a thickness in the range of 0.25 mm to 0.35 mm.

4. The coaxial cable according to claim 3, wherein both of the central conductor and the outer conductor are made of nonferrous metal.

5. The coaxial cable according to claim 4, wherein the central conductor is made of any one material selected from the group consisting of copper, copper alloy, silver alloy, and silver plating.

6. The coaxial cable according to claim 5, wherein the central conductor has a conductive layer made of conductive material, and a spiral wrinkle is formed on an outer portion of the conductive layer.

7. The coaxial cable according to claim 4, wherein the outer conductor is made of any one material selected from the group consisting of copper, copper alloy, silver alloy, and silver plating.

8. The coaxial cable according to claim 3, wherein an inner skin layer made of insulating material is coated as a thin film on a surface of the central conductor.

9. The coaxial cable according to claim 8, wherein an outer skin layer is coated on an outer surface of the dielectric layer.

10. The coaxial cable according to claim 3, wherein an outer skin layer is coated on an outer surface of the dielectric layer.

11. The coaxial cable according to claim 1, wherein the outer conductor has conductivity in the range of 102% to 103% and a thickness in the range of 0.25 mm to 0.35 mm.

12. The coaxial cable according to claim 11, wherein both of the central conductor and the outer conductor are made of nonferrous metal.

13. The coaxial cable according to claim 12, wherein the central conductor is made of any one material selected from the group consisting of copper, copper alloy, silver alloy, and silver plating.

14. The coaxial cable according to claim 13, wherein the central conductor has a conductive layer made of conductive material, and a spiral wrinkle is formed on an outer portion of the conductive layer.

15. The coaxial cable according to claim 12, wherein the outer conductor is made of any one material selected from the group consisting of copper, copper alloy, silver alloy, and silver plating.

16. The coaxial cable according to claim 11, wherein an inner skin layer made of insulating material is coated as a thin film on a surface of the central conductor.

17. The coaxial cable according to claim 16, wherein an outer skin layer is coated on an outer surface of the dielectric layer.

18. The coaxial cable according to claim 11, wherein an outer skin layer is coated on an outer surface of the dielectric layer.

* * * * *